United States Patent [19]

Fouch

[11] Patent Number: 5,042,412

[45] Date of Patent: Aug. 27, 1991

[54] WINDSURFER SAIL AND MAST RIGHTING DEVICE AND METHOD

[76] Inventor: Brent Fouch, 6453 E. El Paseo St., Long Beach, Calif. 90815

[21] Appl. No.: 568,774

[22] Filed: Aug. 17, 1990

[51] Int. Cl.[5] ..... B63B 35/79

[52] U.S. Cl. ..... 114/39.2; 114/91

[58] Field of Search ..... 114/39.1, 39.2, 90, 114/91, 97, 102

[56] References Cited

U.S. PATENT DOCUMENTS

| | | | |
|---|---|---|---|
| 3,487,800 | 1/1970 | Schweitzer et al. | 114/39.2 |
| 3,865,061 | 1/1975 | Newman | 114/39.1 |
| 4,498,411 | 1/1985 | Marker | 114/97 |
| 4,938,161 | 7/1990 | Blackmer | 114/91 |

FOREIGN PATENT DOCUMENTS

| | | | |
|---|---|---|---|
| 2920011 | 11/1980 | Fed. Rep. of Germany | 114/39.2 |
| 2938755 | 4/1981 | Fed. Rep. of Germany | 114/39.2 |
| 2939182 | 4/1981 | Fed. Rep. of Germany | 114/39.2 |
| 2306717 | 11/1976 | France | 114/39.2 |
| 2480703 | 10/1981 | France | 114/39.2 |
| 2575720 | 7/1986 | France | 114/39.2 |
| 11488 | 1/1990 | Japan | 114/91 |

OTHER PUBLICATIONS

"Sailboard Uphauler", *Windrider* Aug. 1990.

*Primary Examiner*—Jesus D. Sotelo
*Attorney, Agent, or Firm*—Howard A. Kenyon

[57] ABSTRACT

A device for righting a windsurfer sail and mast that has free fallen along one of a plurality of vertical planes upon release is described. A pulley is attached to a strap which in turn is attached to the mast located approximately half way between the base and the top of the mast. This attaching means allows the pulley to rotate around the mast in a 360 degree arc. A rope is threaded through the pulley where one end contains a loop which is attached to a harness which is worn by the person sailing the windsurfer while the other end contains spherical members attached at even intervals to provide a better grip on the rope. When the sail and mast are released and free fall into the water, pulling on the rope, when properly attached to the person sailing the windsurfer, will right the sail and mast with a 2 to 1 mechanical advantage.

14 Claims, 2 Drawing Sheets

WINDSURFER SAIL AND MAST RIGHTING DEVICE AND METHOD

BACKGROUND OF THE INVENTION

1. Field of the Invention

This invention relates to a device to right a sail and mast of a buoyant windsurfer board. More specifically, this invention provides a device that produces a 2 to 1 mechanical advantage to right a sail and mast of a windsurfer.

2. Description of the Prior Art

There are thousands of surfboards with a sail attached thereto in use today all over the world. These are commonly know as windsurfers. Windsurfers are divided into two types of boards. These types are commonly called long boards, usually used on lakes and bays, and short boards, used in the ocean when riding waves. The dividing line in length is approximately 10 feet whereby the long boards also have a centerboard that can be raised or lowered from the top of the surfboard. Both the long and short boards have a skeg which is a fixed rudder attached to the rear of the board. A short board is usually less than 10 feet and has no centerboard. The invention described herein will be concerned only with a righting device for a long board.

When a windsurfer person "dumps" a sail, both the windsurfer person and the sail are in the water. Usually the windsurfer wears a wet suit which provides some buoyancy. On a long board, which is the concern of the present invention, a windsurfer person of moderate weight can mount the board without the board becoming submerged. When the sail and mast is dumped, it is imperative to get the sail out of the water and in a sailing position as quickly as possible in order to keep the sail from sinking deeper into the water. Unless a windsurfer person is strong, or can use their body weight to an advantage to pull the sail out of the water, it is a difficult task to get the sail up in a sailing position. This is especially true for persons of a smaller stature who do not have the same strength as that of a larger person.

The basic patent for a wind propelled surfboard is U.S. Pat. No. 3,487,700 by Schweitzer and Drake. This patent issued in 1970 and as such the invention is in the public domain. This patent describes wind propulsion means for vehicles including watercraft, iceboats and landcraft. This patent also describes all the steering and control to be accomplished through the sail. In the event of sudden or excessive winds, the user needs only to release the sail and it will fall in any direction freeing the vehicle from any propulsive force. This patent, however, does not provide for any righting device as described herein.

A patent utilizing a righting device is U.S. Pat. No. 3,865,061 to Newman. This device and method is used to right a catamaran which is more difficult than righting the sail of a windsurfer. Newman has an embodiment whereby he obtains a mechanical advantage using pulleys that right a mast of a catamaran. However, the catamaran features two side shroud cables and one cable running fore and aft to the mast tip. Newman uses these shroud cables to an advantage to right the catamaran mast and sail. The present invention has no permanent cables attached to the windsurfer board.

A French patent 2,575-720A to Biasini describes a device to assist righting a sail and mast of a windsurfer. This device is a mobile beam articulated to a mast base and acts as a pull pivot. This device requires less force for righting a sail and mast. Applicant uses no mobile beam to right his sail and mast.

Other patents pertaining to some phase of windsurfing as German patent DC 2939-182 to Jako, German patent 292 0011 assigned to Windglider Thailand Ltd., Bankok, Thailand, German patent DT2920-011 assigned to Windglider Thailand, French patent FR 2480-703 to Marguier, French patent FR 2306-717 to Corn and U.S. Pat. No. 4,498,411 to Marker.

What is needed is a device that can provide a mechanical advantage to those windsurfer persons who cannot provide a combination of weight plus brute force to upright the sail after it has been dumped. The present invention provides such a device that will assist windsurfer persons in uprighting the sail without the need for exceptional strength and weight.

The novel features which are believed to be characteristics of the invention, both as to its organization and its method of operation, together with further objects and advantages thereof, will be better understood from the following description in connection with the accompanying drawings in which a presently preferred embodiment of the invention is illustrated by way of example. It is expressly understood, however, that the drawings are for purpose of illustration and description only, and are not intended as a definition of the limits of the invention.

SUMMARY OF THE INVENTION

It is the object of the present invention to provide a device that rights a windsurfer sail and mast.

It is another object of the present invention to provide a device that rights a windsurfer sail and mast with a 2 to 1 advantage.

It is yet another object of the present invention to provide at least one pulley attached to the windsurfer mast.

It is still another object of the present invention to provide a rope threaded through the pulley with one end fixed and the other end capable of being pulled by a windsurfer person.

Briefly, in accordance with the present invention, there is provided a windsurfer sail and mast righting device that uses at least one pulley mounted on the mast that is rotatably attached to the mast. A rope is threaded through said pulley(s) with one end attached to the harness worn by the windsurfer person and the other end being available for pulling by the windsurfer person. In this manner, a 2 to 1 advantage in pulling power is provided to right the windsurfer sail and mast.

These and other objects, features and advantages of the present invention will become more readily apparent upon detailed consideration of the following description of a preferred embodiment with reference to the accompanying drawings.

DETAILED DESCRIPTION OF THE PREFERRED EMBODIMENT

Figure 1:
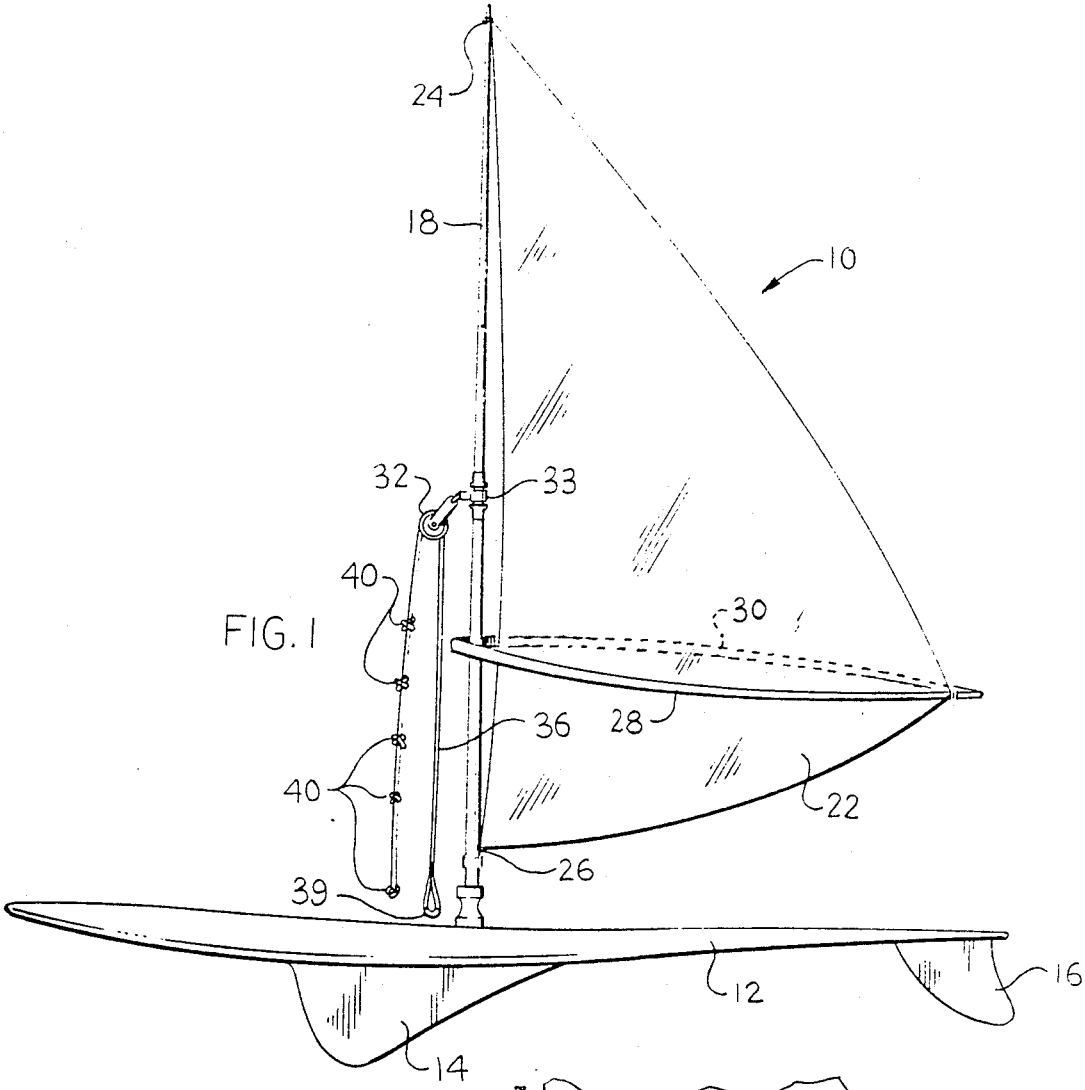
FIG. 1 is a side view of a windsurfer showing windsurfer sail and mast righting device with a single pulley.

Turning now to FIG. 1 there is shown a windsurfer generally shown as 10. The windsurfer consists of a buoyant body 12, a centerboard 14 and a skeg 16.

A mast 18 is fixed to the buoyant body 12 by a universal joint 20. The universal joint 20 may be any type that can provide a free fall in a multiple of planes, however, in the preferred embodiment the universal joint 20 is made from rubber bonded to the bottom end 26 of mast 18 and the buoyant body 12. The rubber universal joint is necked or narrowed in the middle to provide an unrestricted fall.

A sail 22 is attached to mast 18 at the tip 24 and base 26. Located on each side of sail 22 and extending laterally from mast 18 are two booms 28 and 30. Booms 28 and 30 are attached to each other on both ends and to mast 18 such that they can swivel or rotate freely 360 degrees. Pulley 32 is attached to strap 33 which is attached to mast 18 in such a manner that will allow the pulley to also rotate 360 degrees around mast 18. Also seen in this view is rope 36 threaded through pulley 32. On one end of rope 36 is attached a loop 38 and on the other end of rope 36 are spherical members 40 affixed to rope 36. These spherical members 40 provide the windsurfer person with a better grip on rope 36 when righting the mast 18 and sail 22. Included in loop 38 is a quick release mechanism 39 to be used in an emergency.

Figure 2:
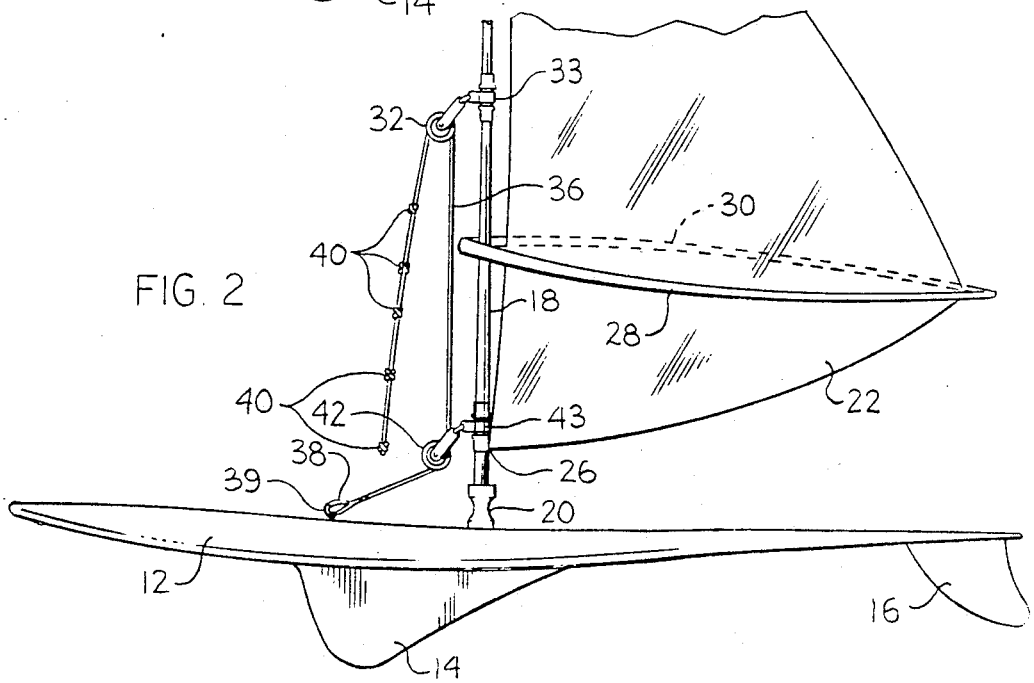
FIG. 2 is a side view of a windsurfer showing a windsurfer sail and mast righting device with dual pulleys.

FIG. 2 shows a configuration similar to that shown in FIG. 1 except that two pulleys are used instead of one. Pulley 42 is attached to strap 43 which in turn is attached to mast 18. Both pulleys 32 and 42 have the capability of rotating 360 degrees around mast 18. Both straps 33 and 43 are secured around mast 18 by Velcro attaching the ends of the straps in such a manner that they can swivel around mast 18.

Figure 3:
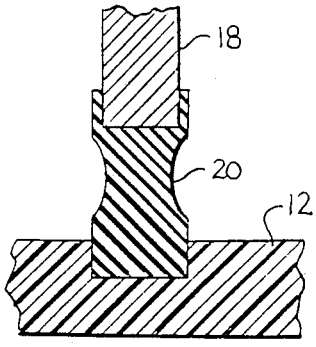
FIG. 3 shows the universal joint that joins the mast to the surfboard structure.

FIG. 3 shows the universal joint 20 that joins mast 18 to the buoyant body 12. This universal joint 20 in the preferred embodiment is a flexible joint that is bonded to the buoyant body 12 on one end and the mast 18 on the other end. It is also noted that universal joint 20 is necked in the center. In this manner the mast 18 and sail 23 may free fall along any of a plurality of vertical planes upon release.

Figure 4:
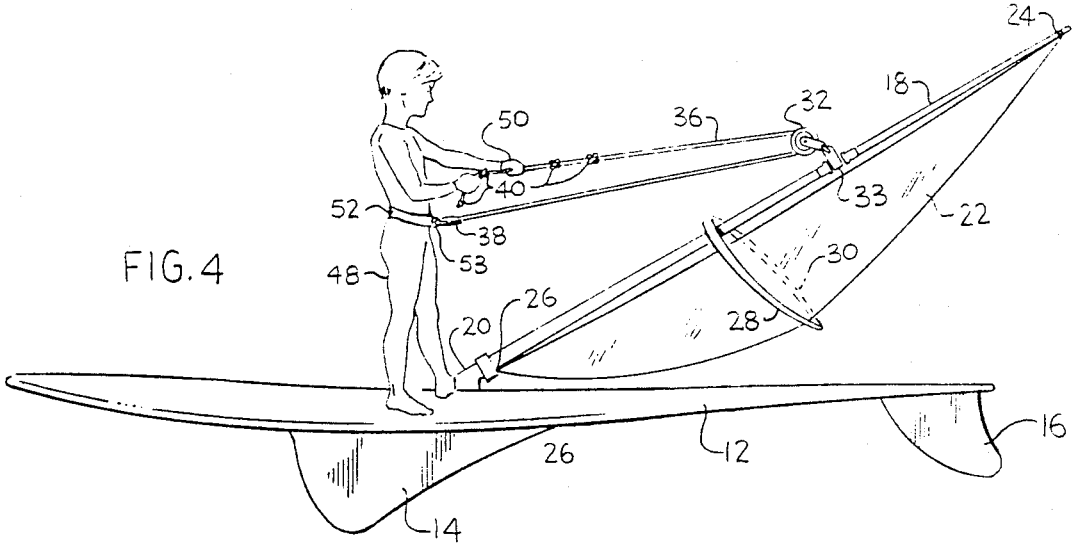
FIG. 4 shows a windsurfer person righting a windsurfer sail and mast having a righting device with a single pulley.

In FIG. 4, there is shown the windsurfer person 48 pulling rope 36 through a single pulley 32. Spherical members 40 attached to rope 36 provides means to ensure the rope will not slip through the windsurfer person's hands 50. FIG. 4 shows a single pulley 32 connected to mast 18 by strap 33. Strap 33 is attached to mast 18 such that strap 33 can turn on mast 18 which will provide pulley 32 with a 360 degree turning capability. The rope 36 passes through pulley 32 and then is attached to loop 38. Loop 38 is in turn attached to harness 52 by hook 53 which is attached to the windsurfer person 48. As can be seen in FIG. 4, the windsurfer person 48 has lifted the mast 18 and sail 22 out of the water and has started the mast 18 and sail 22 toward an upright position with a 2 to 1 mechanical advantage. The remainder of the components of FIG. 4 are the same as shown in FIG. 1.

Figure 5:
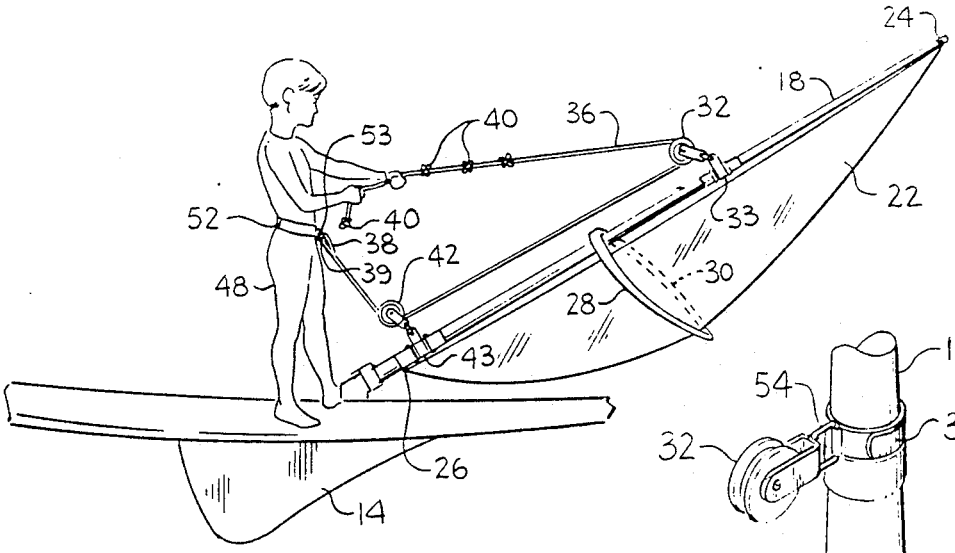
FIG. 5 shows a windsurfer person righting a windsurfer sail and mast having a righting device with dual pulleys.

Turning now to FIG. 5 there is seen a windsurfer person 48 pulling rope 36 through dual pulleys 32 and 42. Again, as in FIG. 4, the windsurfer person is pulling with his hands 50 on spherical members 40 in order to provide a better grip. Dual pulleys 32 and 42 are attached to mast 18 by straps 33 and 43. Both straps 33 and 43 will provide the capability of allowing pulleys 32 and 42 to rotate 360 degrees around mast 18. The dual pulleys 32 and 42 provide the same 2 to 1 mechanical advantage as the single pulley system shown in FIG. 4. Rope 36 is threaded through pulleys 32 and 42 and is attached to loop 38 which in turn is attached to waist harness 52 by hook 53. Dual pulleys 32 and 42 have the advantage of keeping the rope 36 parallel to mast 18 which will prevent the rope 36 from becoming tangled. As can be seen in FIG. 5, the windsurfer person 48 has lifted the mast 18 and sail 22 out of the water and has started the mast 18 and sail 22 toward an upright position. The remaining components of FIG. 5 are the same as shown in FIG. 2.

Figure 6:
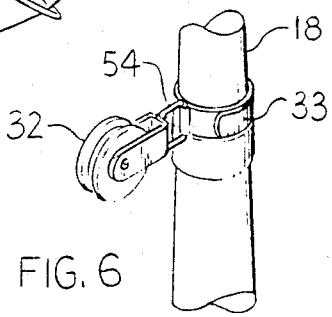
FIG. 6 shows how a strap is used to attach a pulley to the mast.

Turning now to FIG. 6 there is seen a perspective view showing a section of mast 18 and the strap 33. Pulley 32 is hooked to strap 33 by a metal hook 54. In order to provide simplicity and low cost, the ends of strap 33 are fastened to each other by Velcro means.

Thus, it is apparent that there has been provided in accordance with the invention, a windsurfer sail and mast righting device and method that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit and scope of the appended claims.

What is claimed is:

1. A righting device for a windsurfer sail and mast; the windsurfer having a buoyant body at least 10 feet long with a centerboard and a skeg; a mast with a base end and a tip end; said mast base end attached to said buoyant body by a universal joint allowing said mast to be free from pivotal restraint; said mast having a triangular sail attached thereto, said sail extending laterally from said mast, a pair of curved booms with a first and second ends, said first ends rotatably attached to said mast approximately half way between said base end and said tip end, said curved booms extending laterally from said mast with a curved boom located on each side of said sail, said second ends of said booms being configured and joined together to match the lateral tip of said triangular sail, the universal joint on the base end of said mast having a plurality of axis whereby the sail and mast free falls along any of a plurality of vertical planes upon release, said righting device comprising:

restraining means adapted to fit on the body of a person sailing said windsurfer;

a pulley located approximately midway between said base end and said tip end of said mast;

a rope having a first and second end, said first end being fitted through said pulley on said mast;

attaching means on said restraining means to attach said first end of said rope to said restraining means;

holding means on the end portion of said second end of said rope such that when the sail and mast free falls along any of a plurality of vertical planes, pulling on said holding means will right said mast and sail to an upright position with a 2 to 1 mechanical advantage.

2. A righting device as described in claim 1 wherein said restraining means is a harness adapted to fit around a person sailing said windsurfer.

3. A righting device as described in claim 1 wherein said attaching means on said restraining means is a hook fabricated into said harness.

4. A righting device as described in claim 1 wherein a loop is attached to said first end of said rope.

5. A righting device as described in claim 1 wherein said pulley is attached to a strap which is in turn rotatable secured to said mast.

6. A righting device as described in claim 1 wherein said holding means are spherical members placed at even intervals along the end portion of said second end of said rope.

7. A righting device for a windsurfer sail and mast; the windsurfer having a buoyant body at least 10 feet long with a centerboard and a skeg; a mast having a base end and a tip end; said mast base end attached to said buoyant body by a universal joint allowing said mast to be free from pivotal restraint; said mast having a triangular sail attached thereto, said sail extending laterally from said mast, a pair of curved booms having first and second ends, said first ends rotatably attached to said mast approximately half way between said base end and said tip end, said curved booms extending laterally from said mast with a curved boom located on each side of said sail, said second ends of said booms being configured and joined together to match the lateral tip of said triangular sail, the universal joint on the base end of said mast having a plurality of axis whereby the sail and mast free falls along any of a plurality of vertical planes upon release, said righting device comprising:

a restraining means adapted to fit around a person sailing said windsurfer;

a first pulley located approximately midway between said base end and said tip end of said mast;

a second pulley located on the base portion of said mast;

a rope having a first and second end, said first end being threaded through said first pulley attached to said mast and said second pulley attached to said mast;

attaching means on said restraining means to attach said first end of said rope to said restraining means;

holding means on the end portion of said second end of said rope such that when the sail and mast free falls along any of a plurality of vertical planes, pulling on said holding means will right said mast and sail to an upright position with a 2 to 1 mechanical advantage.

8. A righting device as described in claim 7 wherein said restraining means is a waist harness belt adapted to fit around a person sailing said windsurfer.

9. A righting device as described in claim 7 wherein said attaching means on said restraining means is a hook fabricated into said harness belt.

10. A righting device as described in claim 7 wherein a loop is attached to said first end of said rope.

11. A righting device as described in claim 7 wherein said first pulley is attached to a strap which is in turn rotatable secured to said mast.

12. A righting device as described in claim 7 wherein said second pulley is attached to a strap located on the base portion of said mast.

13. A righting device as described in claim 7 wherein said holding means are spherical members placed at even intervals along the end portion of said second end of said rope.

14. A method for righting a wind surfer sail and mast lying flat on the water surface, the windsurfer having a buoyant body at least 10 feet long with a centerboard and a skeg; a mast having a base end and a tip end; said mast base end attached to said buoyant body by a universal joint allowing said mast to be free from pivotal restraint; said mast having a triangular sail attached thereto, said sail extending laterally from said mast, a pair of curved booms having first and second ends, said first ends rotatably attached to said mast approximately half way between said base end and said tip and, said curved booms extending laterally from said mat with a curved boom located on each side of said sail, said second end of said booms being configured and joined together to match the lateral tip of said triangular sail, the universal joint on the base end of said mast having a plurality of axis whereby the sail and mast free falls along any of a plurality of vertical planes upon release, said righting device comprising:

providing a harness adapted to fit around a person sailing said windsurfer and also having a hook attached to said harness;

providing a rope having a first and second end wherein said first end contains a loop and said second end contains spherical members evenly spaced along said end portion of said second end;

providing a pulley attached to said mast for accepting said rope;

threading said rope through said pulley attaching said loop to said hook on said harness;

pulling on said second end of said rope containing spherical members whereby using a 2 to 1 mechanical advantage said mast and sail is pulled upright.

* * * * *